US011602672B2

(12) United States Patent
Emmert

(10) Patent No.: US 11,602,672 B2
(45) Date of Patent: Mar. 14, 2023

(54) STILT DEVICE WITH STRENGTHENING RIBS

(71) Applicant: Emmert Second Limited Partnership, Bethany, OK (US)

(72) Inventor: Raymond L. Emmert, Oklahoma City, OK (US)

(73) Assignee: Emmert Second Limited Partnership, Oklahoma City, OK (US)

( * ) Notice: Subject to any disclaimer, the term of this patent is extended or adjusted under 35 U.S.C. 154(b) by 217 days.

(21) Appl. No.: 17/247,594

(22) Filed: Dec. 17, 2020

(65) Prior Publication Data

US 2022/0193492 A1 Jun. 23, 2022

(51) Int. Cl.
*A63B 25/00* (2006.01)

(52) U.S. Cl.
CPC ..... *A63B 25/00* (2013.01); *A63B 2225/093* (2013.01)

(58) Field of Classification Search
CPC ... A63B 2225/093; A63B 25/00; A63B 25/02; A63B 25/04; A63B 25/06; A63B 25/08; A63B 25/10; A63B 21/4011; A63B 21/4017; A61F 5/01; A61F 5/0102; A61F 5/0104; A61F 5/0106; A61F 5/0109; A61F 5/0111; A61F 5/0113; A61F 5/0116; A61F 5/0118; A61F 5/012; A61F 5/0123; A61F 5/0125; A61F 5/0127; A61F 5/013; A61F 5/019; A61F 5/0193; A61F 5/0195; A61F 5/05841; A61F 5/0585; A61F 5/058558; A61F 5/05866; A61F 5/05875; A61H 2201/1635; A61H 2201/1638; A61H 2201/164; A61H 2201/1642;

(Continued)

(56) References Cited

U.S. PATENT DOCUMENTS 514,600 A * 2/1894 Johnson ..... A61F 2/60 482/75
1,613,535 A * 1/1927 Root ..... A63B 25/00 482/75

(Continued)

FOREIGN PATENT DOCUMENTS

KR 101009710 B1 * 5/2010

OTHER PUBLICATIONS

KR 101009710 B1 _translate (Year: 2010).*

*Primary Examiner* — Loan B Jimenez
*Assistant Examiner* — Thao N Do
(74) *Attorney, Agent, or Firm* — Hall Estill Law Firm

(57) ABSTRACT

A leg attachment assembly for a stilt device of the type used to support a user above a base surface. The leg attachment assembly has a curvilinearly extending leg band configured to partially surround an upper leg portion of a user's leg. The leg band is attached to a distal end of a support pole using a pair of spacers and associated fasteners. One or more strengthening ribs extend in a lateral direction between contact locations of the spacers. The strengthening ribs extend beyond the spacers to enhance rigidity of the leg band during use. A securement strap can be used to encircle the user's leg and the leg band to attach the stilt to the leg. The strap can be routed between the spacers and over the top surfaces of the strengthening ribs so that, when the strap is tensioned, the ribs prevent slippage or displacement of the strap.

19 Claims, 6 Drawing Sheets

(58) Field of Classification Search
CPC .... A61H 2201/1645; A61H 2201/1647; A61H 2201/165; A61H 2201/1652
USPC ..... 482/75
See application file for complete search history.

(56) References Cited

U.S. PATENT DOCUMENTS 2,216,214 A * 10/1940 Schilling ..... A63B 25/00 623/28
3,058,120 A * 10/1962 Smith ..... A63B 25/00 482/75
3,065,962 A * 11/1962 Hoffmeister ..... A63B 25/08 482/75
3,102,272 A * 9/1963 Emmert ..... A63B 25/00 482/75
3,346,882 A * 10/1967 Wilhoyte ..... A61F 3/00 182/230
3,454,965 A * 7/1969 Kenneth ..... A63B 25/00 623/28
3,626,519 A * 12/1971 Baker ..... A63B 25/00 482/75
3,902,199 A * 9/1975 Emmert ..... A63B 25/00 623/28
4,415,063 A * 11/1983 Hutchison ..... A63B 25/00 182/230
5,178,595 A * 1/1993 MacGregor ..... A61H 3/02 482/75
6,494,919 B1 * 12/2002 Matthews ..... A61F 2/601 623/32
6,648,803 B1 * 11/2003 Jay ..... A63B 25/00 482/76
6,719,671 B1 * 4/2004 Bock ..... A63B 25/10 482/76
7,108,640 B2 9/2006 Emmert
7,744,509 B1 * 6/2010 Emmert ..... A63B 21/023 482/75
7,780,581 B1 * 8/2010 Emmert ..... A63B 25/10 135/65
7,981,003 B1 * 7/2011 Jacobson ..... A63B 25/00 482/25
7,981,008 B1 * 7/2011 Sener ..... A63B 25/00 623/28
8,047,969 B1 * 11/2011 Jay ..... A63B 25/02 482/75
8,172,730 B2 5/2012 Emmert
10,039,956 B1 * 8/2018 Lin ..... A63B 21/4015
D877,814 S * 3/2020 Beland ..... D21/422
2002/0077704 A1 * 6/2002 Lin ..... A63B 25/00 623/28
2003/0203793 A1 * 10/2003 Emmert ..... A63B 21/4011 482/75
2006/0217241 A1 * 9/2006 Novara ..... A63B 25/00 482/75
2007/0027004 A1 * 2/2007 Novara ..... A63B 25/00 482/75
2007/0167296 A1 * 7/2007 Hika ..... A63B 25/00 482/76
2007/0232459 A1 * 10/2007 Lin ..... A63B 25/00 482/75
2008/0058171 A1 * 3/2008 Sener ..... A63B 25/00 623/28
2008/0096732 A1 * 4/2008 Lin ..... A63B 25/00 24/191
2010/0048361 A1 * 2/2010 Smith ..... A63B 25/00 482/75
2010/0093501 A1 * 4/2010 Singleton ..... A63B 25/02 482/75
2011/0130251 A1 * 6/2011 Emmert ..... A63B 25/02 482/76
2011/0275490 A1 * 11/2011 Sener ..... A63B 21/4011 482/75
2013/0296746 A1 * 11/2013 Herr ..... A63B 23/0405 601/34
2022/0193492 A1 * 6/2022 Emmert ..... A63B 25/00

* cited by examiner

STILT DEVICE WITH STRENGTHENING RIBS

BACKGROUND

Stilt devices enable a user to perform work at an elevated height above a base surface. Such devices are often used in the construction industry to facilitate operations several feet above the ground or floor level which would not otherwise be reachable without a scaffold, ladder or other support structure.

A number of useful stilt devices are known in the art, such as taught in U.S. Pat. Nos. 3,902,199, 7,108,640 and 8,172,730, each of which is assigned to the assignee of the present disclosure. Such stilts may be configured to be adjustable in height over a selected range through the use of telescopic struts. Different models of stilts can further be used to provide different ranges of adjustability. For example, one model of stilts may be provided that can be incrementally adjusted from a lower height of 18 inches to an upper height of 24 inches, whereas a different model of stilts may accommodate increments of from 24 to 40 inches, etc.

It is important that the stilt devices be steady and secure, particularly at interface locations between the user's legs and the stilts. Accordingly, while existing stilt devices have been found operable in this regard, there remains a continual need for improvements in stilt designs to enhance usefulness, safety and comfort. It is to these and other improvements that various embodiments of the present disclosure are generally directed.

SUMMARY

Various embodiments of the present disclosure are generally directed to an improved stilt device that utilizes strengthening ribs in a leg attachment assembly of the stilt device.

Without limitation, in some embodiments a leg attachment assembly is provided for a stilt device of the type used to support a user above a base surface. The leg attachment assembly has a curvilinearly extending leg band configured to partially surround an upper leg portion of a user's leg. The leg band is attached to a distal end of a support pole using a pair of spacers and associated fasteners. One or more strengthening ribs extend in a lateral direction between contact locations of the spacers. The strengthening ribs extend beyond the spacers to enhance rigidity of the leg band during use. A securement strap can be used to encircle the user's leg and the leg band to attach the stilt to the leg. The strap can be routed between the spacers and over the top surfaces of the strengthening ribs so that, when the strap is tensioned, the ribs prevent slippage or displacement of the strap.

These and other features and advantages which characterize various embodiments will be apparent from a reading of the following detailed description and a review of the associated drawings.

It will be understood that the various drawings are representative in nature and are not necessarily drawn to scale or with precise aspect ratios, etc. Nevertheless, the drawings are sufficiently clear and detailed to enable a full understanding of the disclosed subject matter.

DETAILED DESCRIPTION

Various embodiments of the present disclosure are generally directed to stilt devices of the type configured to enable a user to stand, walk and work at an elevated height above a base (e.g., floor) surface.

Figure 1:
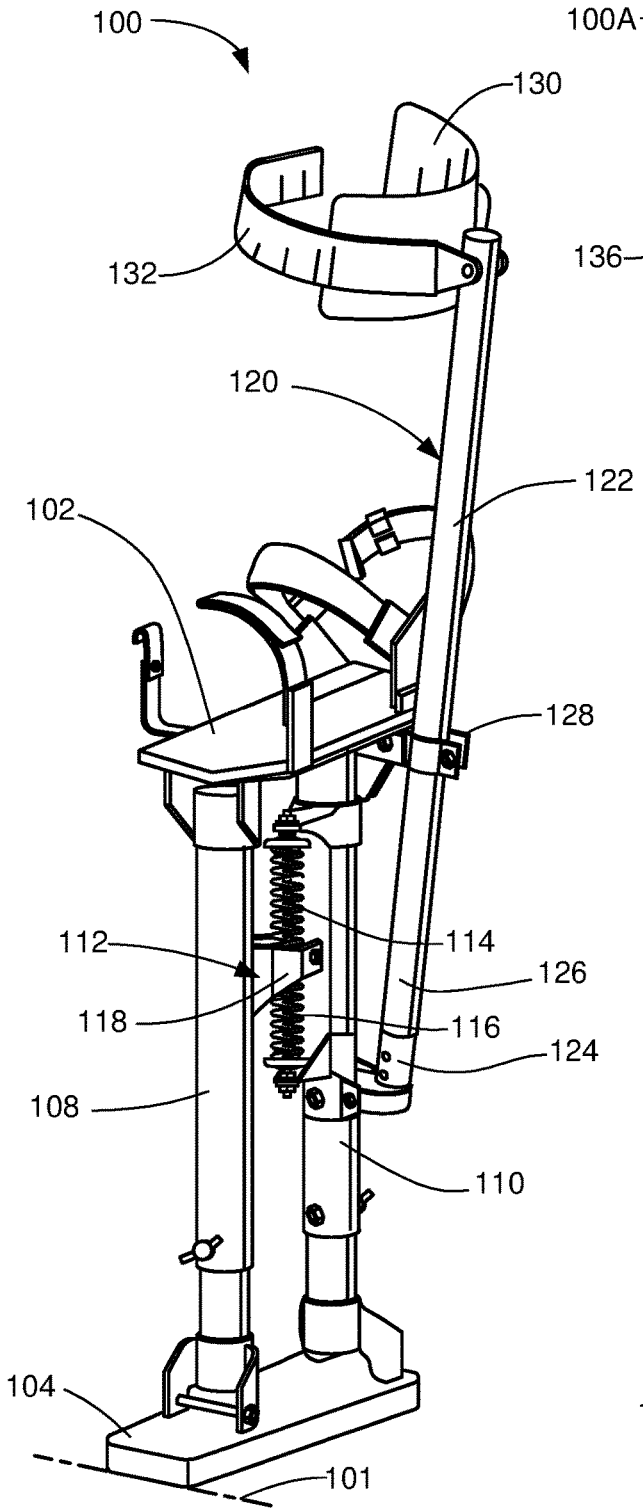
FIG. 1 (Related Art)
FIG. 1 is a front isometric view of a stilt device of the related art.
Figure 2:
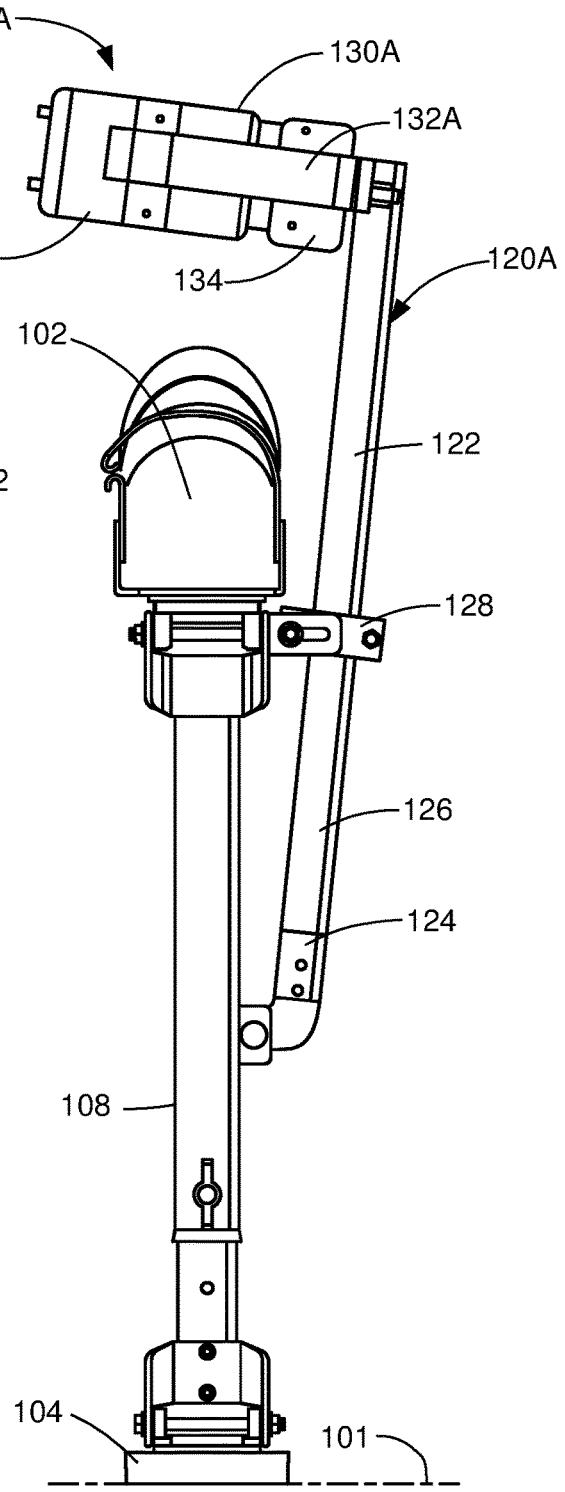
FIG. 2 (Related Art)
FIG. 2 is a front elevational view of another stilt device of the related art.

Reference is first made to FIGS. 1 and 2, which show respective stilt devices 100, 100A ("stilts") of the related art in order to depict different operational environments in which various embodiments of the present disclosure can be advantageously implemented. The stilt devices 100, 100A are nominally identical except that the respective devices use different configurations of leg attachment mechanisms. As such, the same reference numerals have been used for identical components appearing in each of FIGS. 1 and 2.

Each of the stilt devices 100, 100A form one of a pair of such devices that can be used to support a user above an underlying support surface 101. Each pair includes a left-side stilt for attachment to and support of the user's left leg, and a mirrored right-side stilt for attachment to and support of the user's right leg. For reference, the stilts 100, 100A are configured as left-side stilts.

A normally horizontal foot plate 102 is configured to attach to a shoe or boot worn by the user. A floor plate 104 is provided to contact the support surface 101. Front and rear struts 108, 110 are pivotally attached to and extend upwardly from the floor plate 104 to pivotally support the foot plate 102. The front and rear struts 108, 110 are telescopic to permit selective adjustment of the height that the associated stilt devices will elevate the user.

A damping assembly 112 interconnects the front and rear struts 108, 110 to bias the stilts in the parallelogram relationship depicted in FIG. 1. The damping assembly 112 comprises upper and lower damping springs 114, 116 that are affixed by brackets to the rear strut 110 and to a rigid actuator arm 118. The actuator arm 118 is attached to, and extends from, the front strut 108 to a medial position between the springs 114, 116.

In addition to maintaining the parallelogram relationship of the struts 108, 110, the damping assembly 112 provides flexibility and cushioning to the user by permitting limited forward and rearward pivoting of the struts 108, 110 with respect to the foot plate 102 and the base member 104 as user walking or other leg movement occurs.

A leg attachment assembly 120 serves to support a portion of the user's leg just below the user's knee. The leg attachment assembly 120 has a telescopic leg support pole 122 that can be adjusted as desired to properly fit the user's leg length. The leg support pole 122 includes an inner sleeve 124 and an outer sleeve 126, with the lower end of the inner sleeve 124 attached to the rear extendible strut 110 by a connector member (not separately denoted). The length and angle of the leg support pole 122 can be adjusted and secured using a leg attachment clamp 128 which clampingly engages a medial portion of the outer sleeve 126. It will be noted that the foregoing features also appear in a corresponding leg attachment assembly 120A in FIG. 2. While a telescopic leg support pole 122 is contemplated, such is not necessarily required.

The leg attachment assembly 120 in FIG. 1 has a leg attachment mechanism that includes a band member 130 (or "leg band") and one or more attachment straps 132. The leg band 130 is a curvilinearly extending, rigid support formed of metal or other suitable material. The strap(s) 132 are formed of a durable, flexible material such as leather, nylon, etc. The stilt 100 is attached to the user's leg by wrapping the strap(s) 132 around the leg from one side to the other of the leg band 130, securing the strap(s) using a suitable tightening mechanism such as a buckle (not separately shown).

With reference to FIG. 2, the stilt device 100A uses a different style of leg attachment mechanism compared to that shown in FIG. 1. The attachment mechanism in FIG. 2 includes a clamshell member 130A and an attachment strap 132A. The clamshell member 130 uses hinged band members 134, 136 (leg bands) which can be opened and closed to surround the user's leg, and secured in this orientation using the strap 132A. As before, the hinged leg bands 134, 136 can be formed of any suitable material such as metal.

Figure 3:
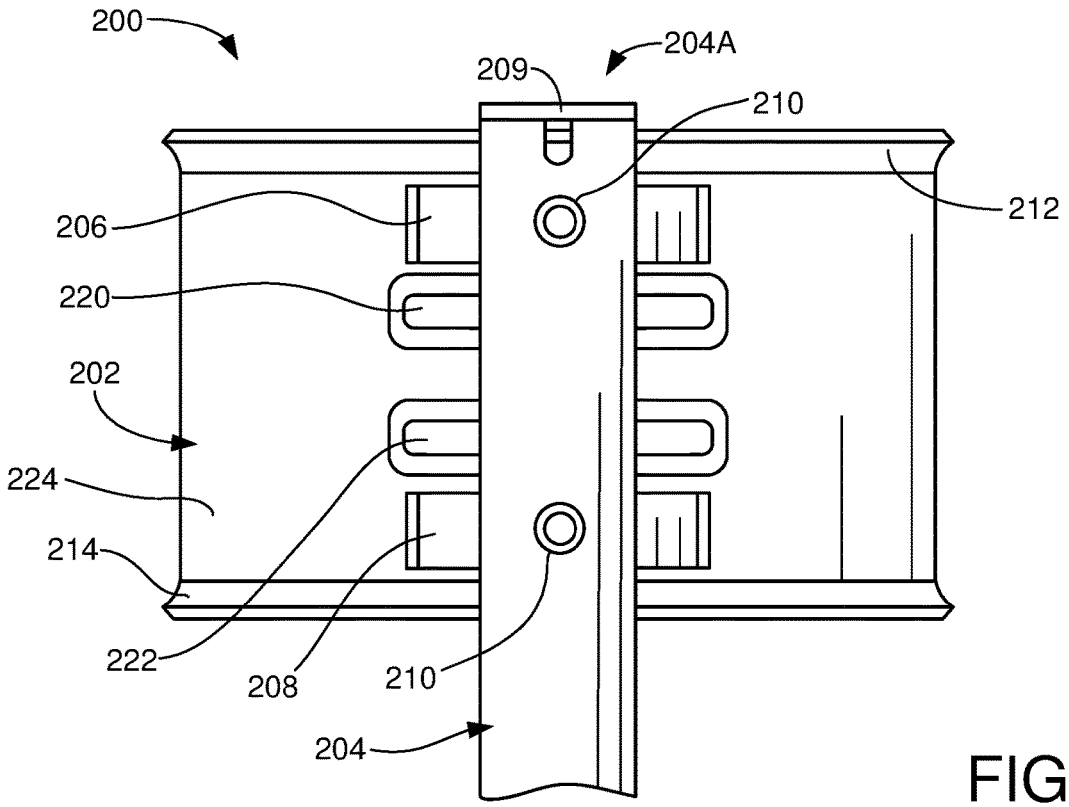
FIG. 3 provides a side elevational view of a leg attachment assembly constructed and operated in accordance with various embodiments of the present disclosure.
Figure 4:
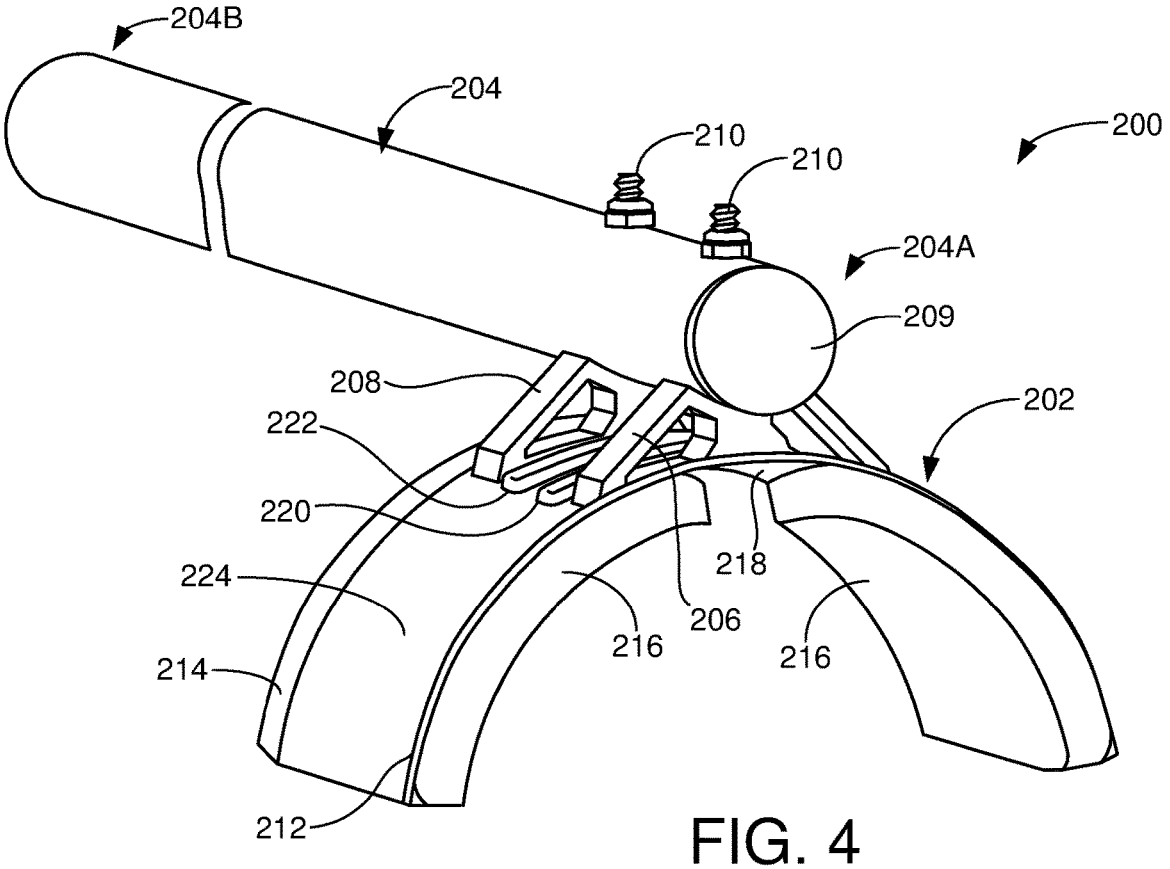
FIG. 4 is an isometric depiction of the leg attachment assembly of FIG. 3.

FIGS. 3 and 4 show respective elevational and isometric depictions of a leg attachment assembly 200 constructed and operated in accordance with various embodiments of the present disclosure. The leg attachment assembly 200 can be incorporated into any number of existing stilt designs, including but not limited to those described above in FIGS. 1-2.

The leg attachment assembly 200 includes a curvilinearly extending leg band member 202 (leg band). The leg band 202 is similar to the leg band 130 in FIG. 1, in that a strap (not separately shown in FIGS. 3-4) can be used to wrap around and attach the leg of the user to the leg band 202. It will be noted that the various novel features of the leg band 202 discussed below can be implemented in one or both of the leg bands 134, 136 of the clamshell assembly 130A in FIG. 2.

The leg band 202 is attached to a cylindrical support pole 204 using upper and lower support spacers 206, 208. The support pole 204 is similar to the support pole 122 in FIGS. 1-2, in that the support pole 204 may be configured as a hollow, cylindrical outer sleeve similar to the outer sleeve 126 and can be telescopically extended about an inner sleeve such as the inner sleeve 124. Other arrangements can be used. Proximal and distal ends of the support pole 204 are denoted in FIG. 4 at 204A, 204B. An end cap 209 can be affixed to the proximal end 204A of the pole 204 as desired.

The upper and lower spacers 206, 208, also sometimes referred to as first and second spacers, spacer members, etc., are substantially triangular in configuration, and each have a central interior channel to enable the use of threaded fasteners 210 (each having a bolt and nut arrangement) to securely attach the leg band 202 to the pole 204. The upper and lower spacers 206, 208 are also sometimes referred to as first and second spacers.

The leg band 202 further includes upper and lower (first and second) strengthening flanges 212, 214. The flanges extend along the respective upper and lower edges of the leg band 202 to enhance rigidity and strength of the leg band, as well as to enhance user comfort. The flanges 212, 214 are radiused outwardly at a selected radius of curvature, but other configurations can be used. Optional interior foam pads 216 are adhesively affixed to an interior surface 218 of the leg band 202 (see FIG. 4). The pads 216 extend inwardly to compressingly engage a side of the user's leg to enhance comfort and security of attachment.

Of particular interest are a pair of strengthening ribs 220, 222. The strengthening ribs, sometimes referred to as first and second ribs or upper and lower ribs, extend in a lateral direction along the curvature of the leg band 202 in spaced apart relation along a medial portion of the leg band 202. As explained below, the ribs are elongated detents (channels) raised above an outer curved surface 224 of the leg band 202. The ribs 220, 224 are located between, and nominally extend laterally beyond the outermost edges of the support spacers 206, 208. In this way, the ribs enhance the structural rigidity of the leg band 202, thereby reducing the ability of the leg band to fold or otherwise be deformed inwardly (or outwardly) along a deformation path adjacent the support spacers.

Figure 5A:
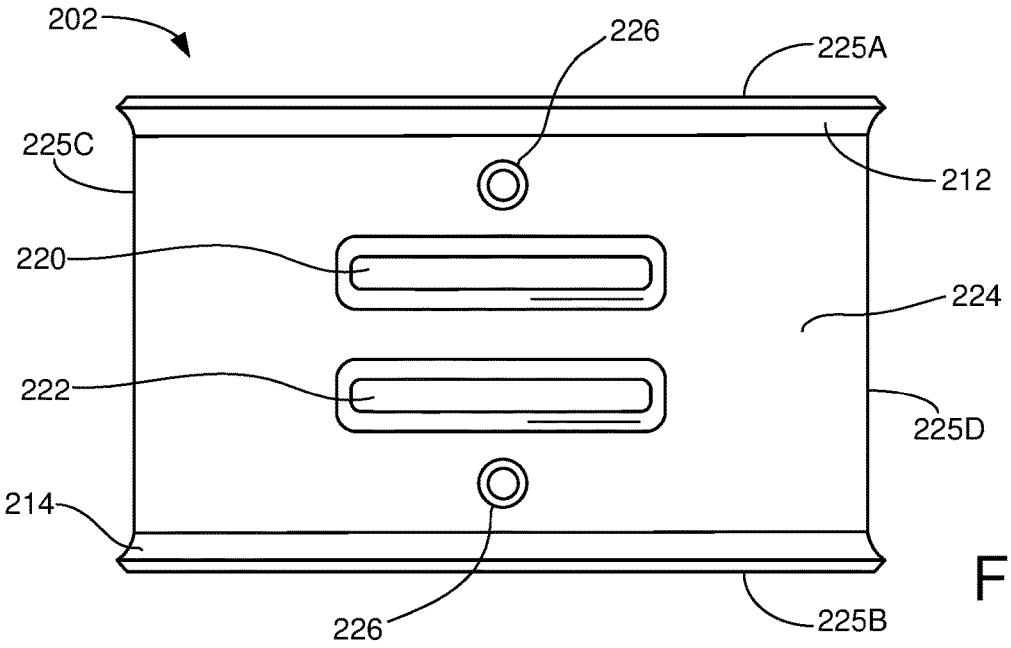
FIGS. 5A, 5B and 5C show respective views of a leg band of the leg attachment assembly in some embodiments.
Figure 5B:
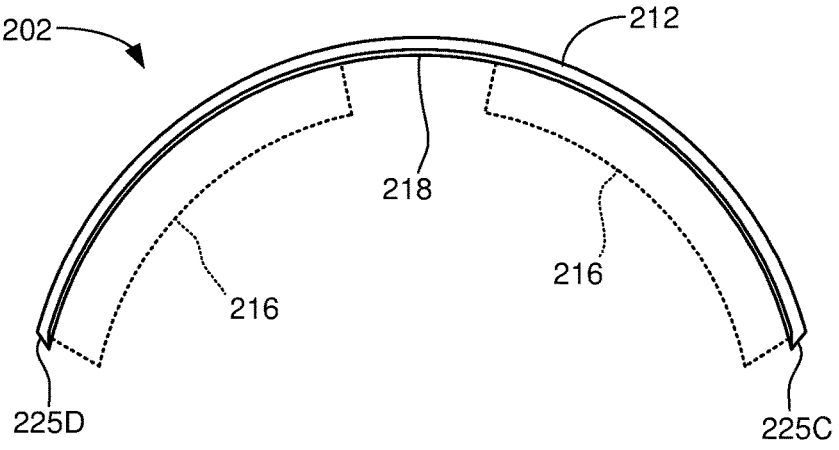
Figure 5C:
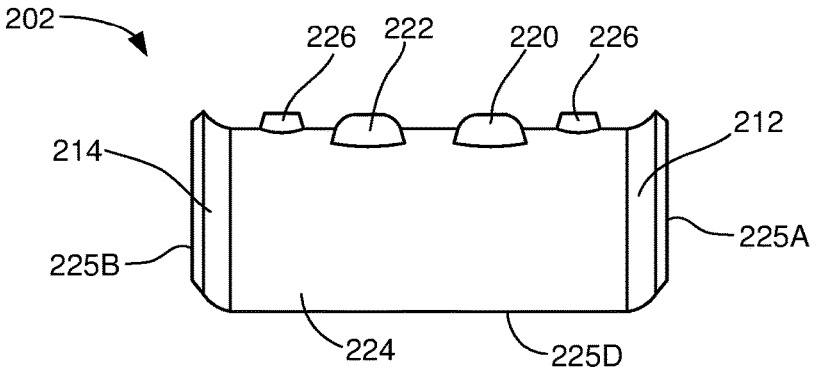

FIGS. 5A through 5C show further views of the leg band 202. FIG. 5A is a side elevational view, FIG. 5B is a top-down view, and FIG. 5C is an end elevational view. From these figures it can be seen that, generally, the leg band 202 is a rigid, curvilinearly extending member configured to be placed adjacent an upper leg portion of the user below the user's knee. As oriented in FIG. 5A, the leg band 202 has a first (top) edge surface 225A, a second (bottom) edge surface 225B, a first (left) side surface 225C, and a second (right) side surface 225D. The flange 212 extends along edge surface 225A and the flange 214 extends along edge surface 225B. The ribs 220, 222 are nominally parallel with the edge surfaces 225A, 225B, and are nominally orthogonal to side surfaces 225C, 225D.

As best viewed in FIGS. 5A and 5C, a pair of raised bosses 226 are positioned on opposing sides of the ribs 220, 222. The bosses 226 have through-holes to accommodate the threaded fasteners 210 discussed above in FIGS. 3-4.

In some cases, a die forming operation can be applied to a sheet metal blank of appropriate dimensions to generate the various flanges 212, 214, ribs 220, 222 and bosses 226, as well as to impart the overall desired shape to the finished leg band 202 (e.g., inner and outer curvilinear surfaces 218, 224, etc).

From FIGS. 5B and 5C it will be noted that the respective ribs 220, 222 and the bosses 226 extend outwardly to distal heights above the curvilinearly extending outer surface 224 that are lower than the heights of the respective radiused flanges 212 and 214. This is not necessarily required, as the ribs, bosses and flanges can be configured in any number of other suitable ways. In one alternative embodiment, the rib(s) are directed inwardly rather outwardly as shown. Other alternative configurations will readily occur to the skilled artisan in view of the present disclosure.

Figure 6:
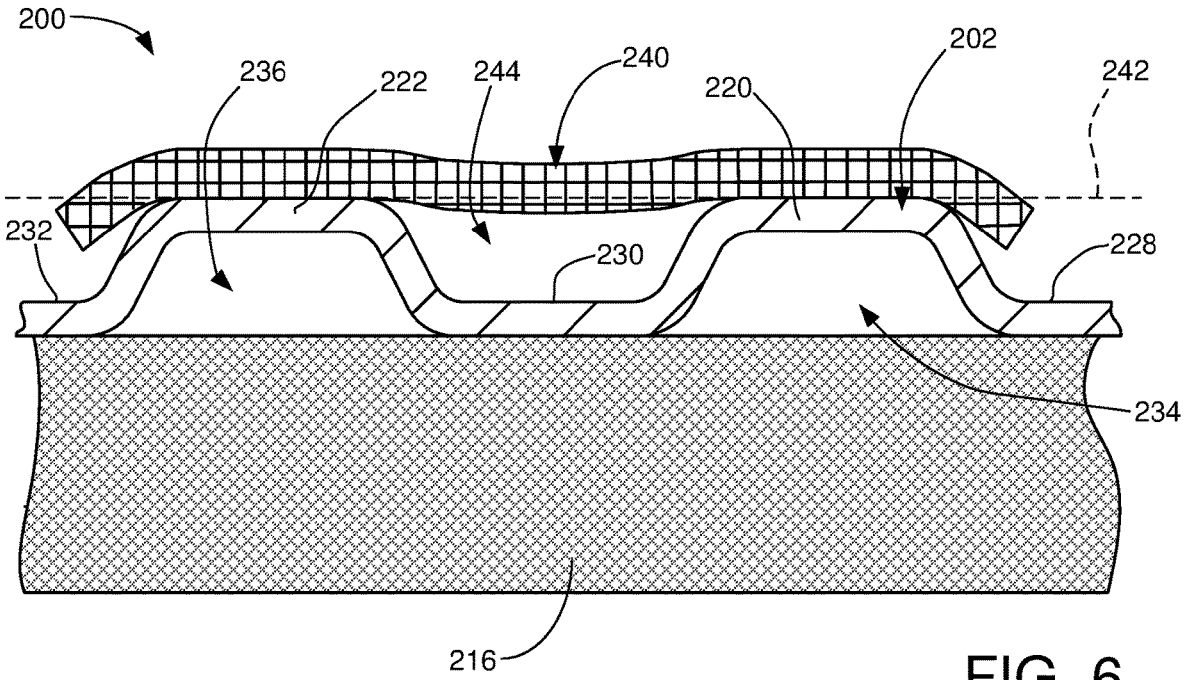
FIG. 6 shows aspects of strengthening ribs of the leg attachment assembly in some embodiments.

FIG. 6 is a cross-sectional, schematic representation of aspects of the leg attachment assembly 200 to illustrate further features of the leg band 202. An end view with an orientation similar to that in FIG. 5C above is provided so that the two raised ribs 220, 222 are shown in side-by-side fashion. As mentioned above, the ribs extend "out of plane" of the rest of the curvilinearly extending body of the leg band 202, so that planar areas 228, 230 and 232 of surface 224 extend adjacent the ribs 220, 222. It will be understood that, when the leg band 202 is oriented for use (see e.g., vertically as in FIGS. 3 and 6), the planar area 228 extends between the first rib 220 and the first strengthening flange 212, the planar area 230 extends between the first and second ribs 220, 222, and the planar area 230 extends between the second rib 222 and the second strengthening flange 214.

Because the ribs 220, 222 in FIG. 6 extend outwardly, interior regions (voids) 234 and 236 are formed between the ribs 220, 222 and the pad 216. However, as desired the pad material can be configured to fill these voids. A suitable adhesive layer (not separately denoted) can be applied to the interior sides of the planar areas 228, 230 and 232 to adhere the respective pads 216 to the inner surface 218 of the leg band 202.

FIG. 6 further shows a cross-sectional representation of a strap 240. The strap 240 is routed along the top surfaces of the respective ribs 220 and 222, and tensioned using a suitable fastener (e.g., buckle, etc.) in order to secure the leg band 202 to the leg of the user. Due to the application of tension in the strap 240, the strap may deform across a strap support plane 242 (shown in dotted line fashion) that nominally aligns with the top surfaces of the ribs 220, 222. More particularly, portions of the strap 240 may be drawn toward the leg band 202, such as into an intermediary gap 244 between the ribs and beyond the outermost extents of the ribs. In this way, the ribs 220, 222 further serve as strap retention features to maintain the strap 240 in a centered relation and reduce longitudinal movement (e.g., slippage) of the strap during use. Such slippage can be envisioned as side-to-side displacement of the strap 240 in FIG. 6.

Figure 7:
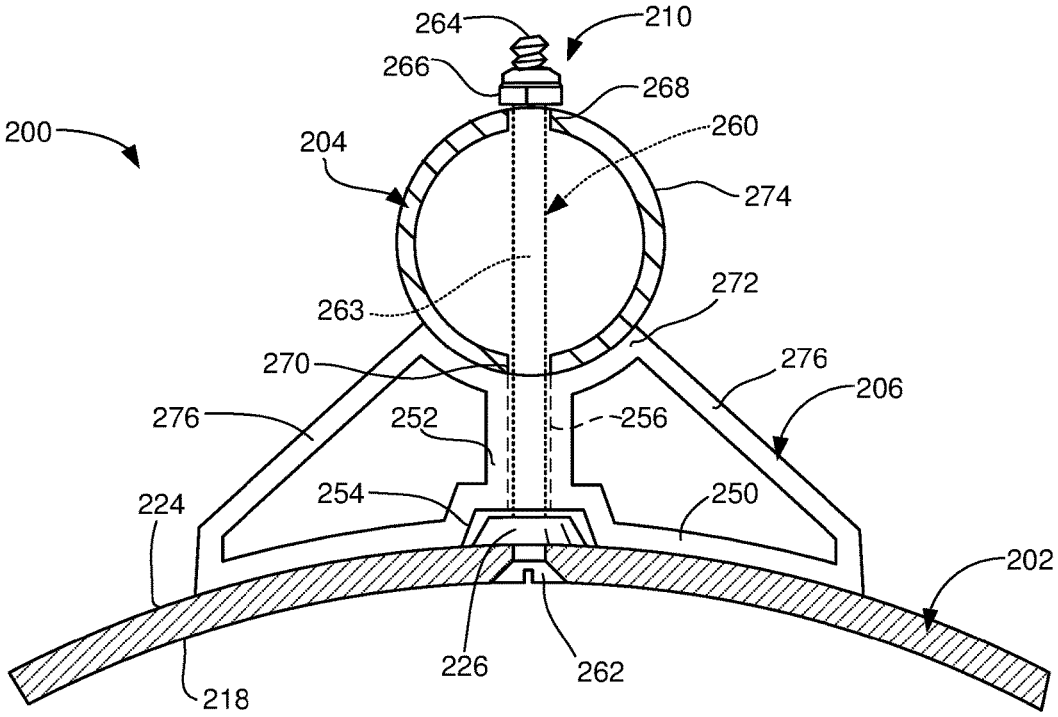
FIG. 7 is a cross-sectional view of the leg attachment assembly.

FIG. 7 shows an end cross-sectional representation of the leg attachment assembly 200 to illustrate further aspects of the upper and lower support spacers 206, 208. The view in FIG. 7 is oriented in a manner similar to the isometric end view discussed above in FIG. 4, but the view is straight-on in FIG. 7, rather than from an angle as in FIG. 4.

The support spacers 206 and 208 are nominally identical, so features of the upper support spacer 206 will be present in the lower support spacer 208 as well. However, this is merely illustrative and not necessarily required; different configurations of spacers can be used, as well as spacers that permit rotational movement of the leg band 202 with respect to the support pole 204, as shown above in the related art stilts in FIGS. 1-2.

The support spacer 206 has a substantially triangular configuration, with interior openings to reduce weight. A curvilinearly extending base portion 250 contactingly engages the outer surface 224 of the leg band 202. A centrally disposed main body portion 252 extends upwardly from the base portion 250. The main body portion 252 has a lower cutout 254 to accommodate the associated boss 226, as well as an interior channel 256 to accommodate passage of the threaded hardware 210.

In this embodiment, the threaded hardware uses a bolt 260 having a countersunk head 262 with an appropriate driver configuration (such as a Phillips style cross-pattern). An intermediate shaft 263 terminates with a threaded end 264 of the bolt 260, which is engaged by a locknut 266. Axially aligned apertures 268, 270 are formed in the support pole 204 to allow passage of the bolt 260 therethrough.

Continuing with the support spacer 206, an upper support portion 272 extends from the main body portion 252 to contactingly support a curvilinearly extending outer surface 274 of the support pole 204. Angled strut portions 276 extend between the upper support portion 272 and the base portion 250.

Figure 8:
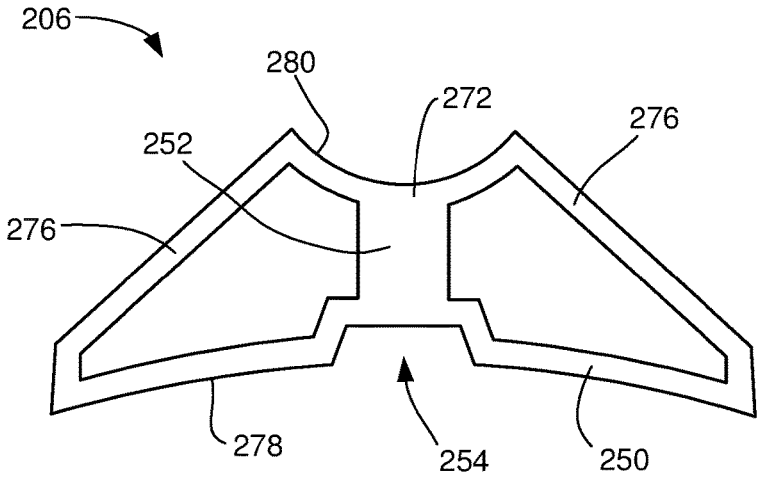
FIG. 8 shows a spacer member of the leg attachment assembly.

FIG. 8 shows the support spacer 206 in greater detail. A lower, curvilinearly extending contact surface 278 of the base portion 250 has a radius of curvature that nominally matches that of the outer surface 224 of the leg band 202. An upper, curvilinearly extending contact surface 282 of the upper support portion 272 similarly has a radius of curvature that nominally matches that of the outer surface 274 of the support pole 204. The strut portions 276 respectively interconnect opposing first and second ends of the base portion 250 to outermost opposing first and second ends of the upper support portion 272, as shown.

While the support spacer 206 is shown to be formed of a unitary piece of material (such as machined aluminum), such is not necessarily required. Multi-piece spacer members can be used, including spacer members made up of components having different material compositions. For example and not by way of limitation, the spacer members can be configured with brackets, rotatable pivots, etc. to facilitate rotational movement of the leg band relative to the support pole. In another example, bushings, compressive layers, etc. can be incorporated into each spacer member.

Figure 9:
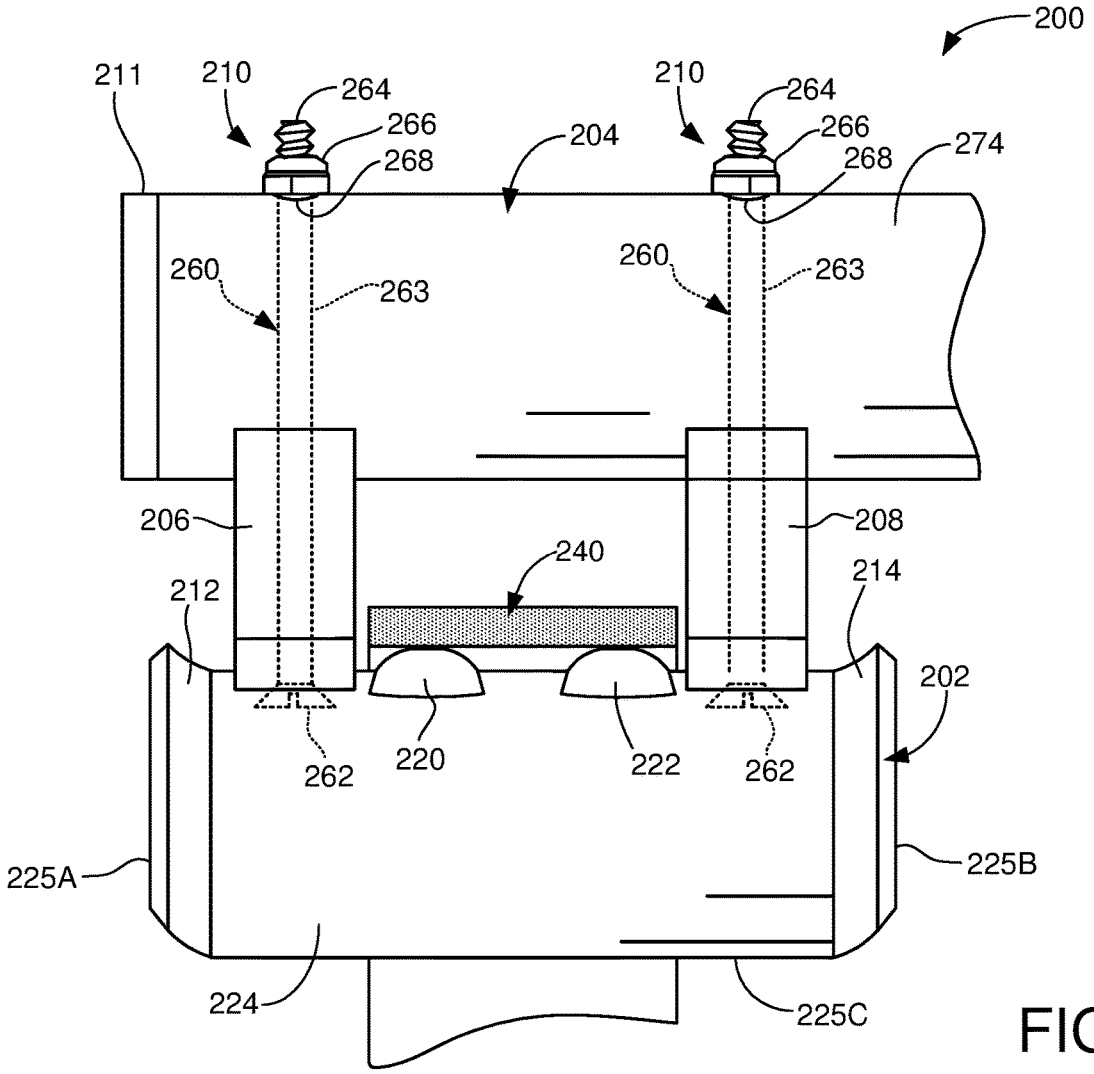
FIG. 9 is another view of the leg attachment assembly.

FIG. 9 shows a side elevational view of the leg support assembly 200. It will be appreciated that the view in FIG. 9 is a side view orthogonal to the view in FIG. 7. Of particular note is the aforementioned strap 240, shown in cross-section, which is loosely wrapped as shown over the top surfaces of the ribs 220, 222 and between the respective support spacers 206, 208. The support spacers thus further serve as a guide channel and retention feature for the strap, once the strap is tensioned about the leg of the user.

While the foregoing discussion has contemplated the use of two strengthening ribs (e.g., ribs 220, 222) with particular sizes and shapes, this is merely illustrative and not limiting. Any number of different sizes, shapes and configurations of strengthening ribs can be used. To this end, FIGS. 10A through 10C have been provided to illustrate further embodiments that can be used as desired. Other configurations will readily occur to the skilled artisan in view of the present disclosure.

Figure 10A:
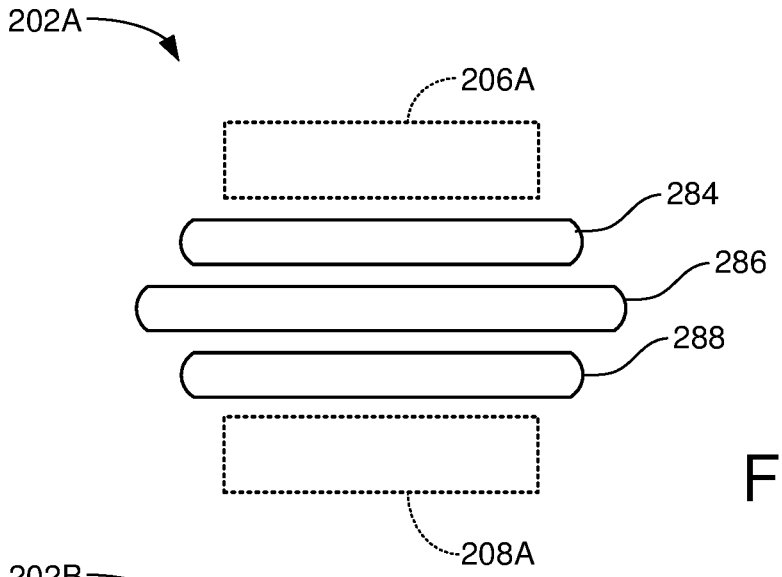
FIGS. 10A, 10B and 10C show alternative configurations that can be used for the strengthening ribs in further embodiments.

FIG. 10A shows an alternative configuration for a leg band 202A otherwise nominally identical to the leg band 202 discussed above. Contact locations 206A, 208A represent the locations at which support spacers such as 206, 208 are located. It will be appreciated that the embodiments of FIGS. 3-9 discussed above are provided with these contact locations 206A, 206B under the spacers 206, 208, even though such are not separately numerically denoted therein. The contact locations represent the overall footprint, or span, over which the respective spacer members engage the underlying outer surface of the leg band; hence, it is not required that the associated spacer make contact with the entire span of the associated contact location, but the contact location indicates the outermost edges of the area over which contact is made.

Three (3) strengthening ribs 284, 286 and 288 are positioned between the locations 206A and 206B. As before, each of the ribs 284, 286 and 288 extend to or beyond, in a lateral direction, the edges of the contact locations 206A and 208A. However, intermediate rib 286 is longer than the ribs 284, 288. Other configurations can be used, such as providing each rib with a different length, providing the outermost ribs 284, 288 with longer lengths than the intermediate rib 286, and so on.

Figure 10B:
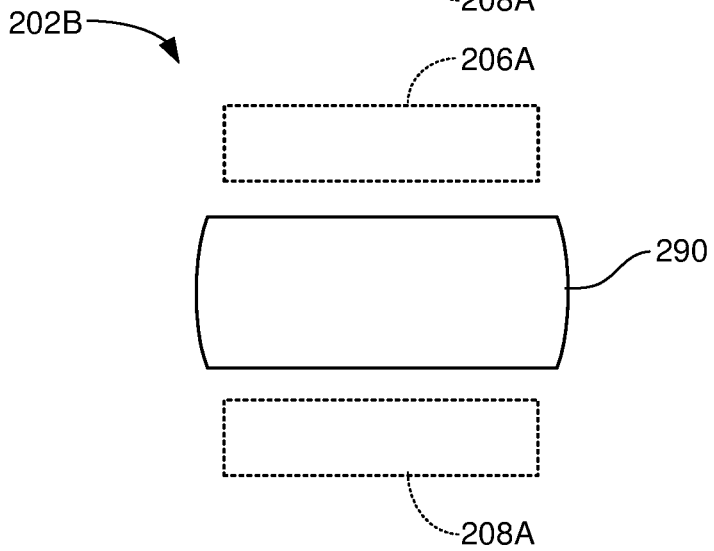

FIG. 10B shows another configuration for a leg band 202B. In this example, a single rib 290 is provided. The rib 290 is provided with a substantially rectangular shape as compared to the substantially elliptical shapes discussed above.

Figure 10C:
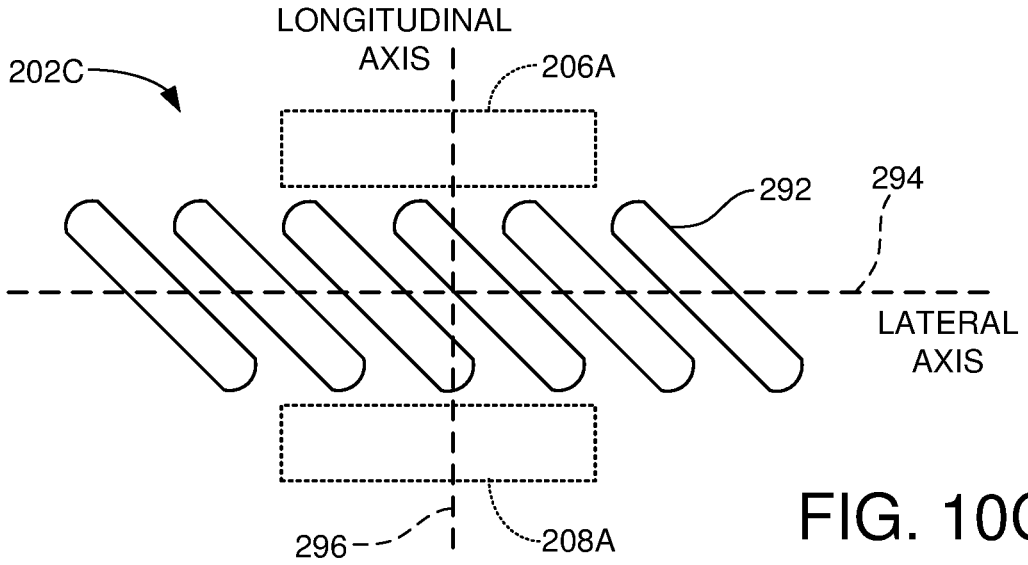

FIG. 10C shows yet another configuration for a leg band 202C. In this example, multiple ribs 292 are provided at a skewed angle with respect to the lateral direction (indicated by lateral axis 294). As noted above, the lateral direction represents the longer dimension of the leg band and is parallel to the upper and lower edge surfaces (see e.g., 225A, 225B in FIG. 3). For reference, the longitudinal direction is orthogonal to the lateral direction as represented by longitudinal axis 296. From these examples, it can be seen that substantially any form, style, shape, length and configuration of strengthening rib(s) can be utilized, depending upon the requirements of a given application.

It will now be appreciated that the various embodiments disclosed herein can provide a number of benefits over the existing art. By providing one or more strengthening ribs that extend up to and/or beyond the contact locations of a pair of spacers, the strength and rigidity of a leg band can be enhanced. Configuring an attachment strap to be tensioned across the ribs can further improve strap retention. Because the leg band will be contactingly supported by the associated spacer member over the corresponding contact location, those portions of the leg band material beyond this contact location may be susceptible to deformation or failure under large stress events. The strengthening ribs accordingly provide enhanced structural rigidity in these areas to reduce or prevent such deformation.

Numerous possible variations and modifications will readily occur to the skilled artisan in view of the foregoing discussion, so it will be understood that the various exemplary embodiments disclosed herein are illustrative of, and are not limiting to, the scope of the claimed subject matter set forth below.

What is claimed is:

1. A leg attachment assembly for a stilt device of the type used to support a user above a base surface, the leg attachment assembly comprising:

a leg band comprising a rigid, curvilinearly extending member configured for placement adjacent a leg portion of the user below a knee of the user, the leg band having opposing upper and lower edge surfaces, opposing left and right side surfaces, a curvilinearly extending inner surface, and a curvilinearly extending outer surface;

a support pole having opposing proximal and distal ends; and first and second spacer members configured to attach the proximal end of the support pole to a medial portion of the leg band using associated fasteners, the first spacer member contactingly engaging the curvilinearly extending outer surface of the leg band at a first contact location adjacent the upper edge surface, the second spacer member contactingly engaging the curvilinearly extending outer surface of the leg band at a second contact location adjacent the lower edge surface, the first and second contact locations each having an overall span in a lateral direction parallel to the upper and lower edge surfaces;

the leg band further comprising at least one strengthening rib extending in the lateral direction between the first and second contact locations, each of the first and second contact locations having a first overall length, the at least one strengthening rib having a second overall length greater than the first overall length of each of the first and second contact locations, the leg attachment assembly further comprising a strap configured to attach the leg band to the upper leg portion of the user, the strap configured to be positioned across a top surface of the at least one strengthening rib and between the first and second spacer members so as to be oriented along the lateral direction.

2. The leg attachment assembly of claim 1, wherein the leg band is formed of metal, and wherein the at least one strengthening rib comprises a channel formed in the metal so that the at least strengthening rib extends outwardly beyond the curvilinearly extending outer surface of the leg band and away from the curvilinearly extending inner surface of the leg band.

3. The leg attachment assembly of claim 2, wherein the channel is formed using a die forming operation.

4. The leg attachment assembly of claim 2, further comprising a first raised boss between the at least one strengthening rib and the upper edge surface of the leg band and a second raised boss between the at least one strengthening rib and the lower edge surface of the leg band to accommodate the associated fasteners used to secure the support pole to the leg band.

5. The leg attachment assembly of claim 1, wherein each of the first and second spacer members comprises a base portion, a main body portion and an upper support portion, the base portion configured to contactingly engage the curvilinearly extending outer surface of the leg band, the upper support surface configured to contactingly engage an outer surface of the support pole, and the main body portion having a central channel to accommodate passage of the associated fastener used to secure the support pole to the leg band.

6. The leg attachment assembly of claim 5, wherein the base portion has a lower curvilinearly extending surface having a radius of curvature that nominally matches that of the curvilinearly extending outer surface of the leg band.

7. The leg attachment assembly of claim 5, wherein the upper support portion has an upper curvilinearly extending surface having a radius of curvature that matches that of an outer surface of the support pole, and wherein each of the first and second spacer members further comprises a pair of strut members which respectively interconnect outermost opposing first and second ends of the base portion to outermost opposing first and second ends of the upper support portion.

8. The leg attachment assembly of claim 1, wherein the at least one strengthening rib comprises a total of two parallel ribs arranged to extend and between the first and second spacer members.

9. The leg attachment assembly of claim 1, wherein the strap comprises an elongated flexible strip of material.

10. The leg attachment assembly of claim 1, wherein the at least one strengthening rib is characterized as a plurality of spaced apart, parallel.

11. The leg attachment assembly of claim 1, wherein the at least one strengthening rib extends beyond each of a pair of opposing ends of the respective first and second contact locations for the first and second spacer members in the lateral direction.

12. The leg attachment assembly of claim 1, wherein the support pole comprises as a first hollow cylindrical sleeve configured to telescopically engage a second hollow cylindrical sleeve.

13. The leg attachment assembly of claim 1, wherein the at least one strengthening rib comprises a total of two identical spaced apart strengthening ribs.

14. The leg attachment assembly of claim 1, wherein the at least one strengthening rib is skewed with respect to the lateral direction.

15. The leg attachment assembly of claim 1, further comprising a first strengthening flange extending along the upper edge surface and a second strengthening flange extending along the lower edge surface.

16. The leg attachment assembly of claim 1, further comprising at least one elastomeric pad adhesively affixed to the curvilinearly extending inner surface of the leg band, the at least one strengthening rib comprising a raised detent that extends away from the curvilinearly extending inner surface, the pad spanning without contacting an interior surface of the raised detent to form a void region therebetween.

17. In a stilt device having a foot plate adapted to support a foot of a user, a floor plate adapted for contacting engagement with an underlying base surface, and at least one strut extending between the foot plate and the floor plate, the improvement comprising an improved leg support assembly, comprising:

a support pole having a proximal end and a distal end, the distal end affixed to the at least one strut between the foot plate and the floor plate;

a leg band affixed to the proximal end of the support pole using an upper first spacer and a lower second spacer, the leg band comprising a curvilinearly extending member configured to partially surround a leg of the user above the foot plate, the leg band further comprising a first strengthening flange extending along an upper edge surface, a second strengthening flange extending along a lower edge surface, a first strengthening rib parallel to and extending in spaced apart relation to the first strengthening flange and a second strengthening rib parallel to and extending in spaced apart relation to the second strengthening flange, the first and second strengthening ribs arranged in a medial location of the leg band between the upper first spacer and the lower second spacer, the first and second strengthening ribs having a common overall length in a lateral direction longer than respective areas of contact with the leg band by the first and second spacers; a strap formed of elongated flexible material and configured to encircle the leg band and the leg of the user to secure the stilt device thereto, the strap passing between the upper first spacer and the lower second spacer and contactingly engaging respective top surfaces of the first and second strengthening ribs.

18. The improvement of claim 17, wherein the first and second strengthening ribs are elliptical and extend outwardly toward the support pole.

19. The improvement of claim 17, wherein each of the upper first spacer and the lower second spacer has a central channel through which a shaft of a bolt extends to affix the leg band to the support pole.

* * * * *